United States Patent [19]

Septier

[11] 4,118,029

[45] Oct. 3, 1978

[54] METHOD FOR MAKING A TENNIS, BADMINTON OR SIMILAR RACKET NET, NET OBTAINED BY THIS METHOD AND RACKET COMPRISING THIS NET

[76] Inventor: Jacqueline Septier, 8, rue Lentonnet, 75009 Paris, France

[21] Appl. No.: 657,636

[22] Filed: Feb. 12, 1976

[30] Foreign Application Priority Data

Feb. 13, 1975 [FR] France ..... 75 04514
Feb. 11, 1976 [FR] France ..... 76 03755

[51] Int. Cl.[2] ..... A63B 51/02; A63B 51/14

[52] U.S. Cl. ..... 273/73 D; 273/73 E; 273/73 A

[58] Field of Search ..... 273/26 A, 58 C, 67 R, 273/73 R, 73 A, 73 C, 73 D, 73 E, 95 A, 96 D, 1.5 R; 124/20, 90; 245/5; 66/195; 36/122

[56] References Cited

U.S. PATENT DOCUMENTS

| | | | |
|---|---|---|---|
| 854,024 | 5/1907 | Brown | 273/73 D |
| 1,531,778 | 3/1925 | Gallaudet | 273/73 D |
| 1,558,507 | 10/1925 | Ryder | 273/73 E |
| 2,089,118 | 8/1937 | Fritsch | 273/73 E |
| 2,508,521 | 5/1950 | Lay | 124/90 X |
| 2,769,439 | 11/1956 | Layer | 124/30 A |
| 3,656,749 | 4/1972 | Reyes | 273/1.5 R X |
| 3,714,316 | 1/1973 | Angeloff | 124/90 X |
| 3,724,850 | 4/1973 | Stevens | 273/73 E |
| 3,822,062 | 7/1974 | Tucker et al. | 273/96 D |
| 3,966,207 | 6/1976 | Pass | 273/73 D |
| 4,026,553 | 5/1977 | Vendramini | 273/73 E |
| 4,049,273 | 9/1977 | Pool | 273/96 D |

FOREIGN PATENT DOCUMENTS

| | | | |
|---|---|---|---|
| 620,043 | 2/1927 | France | 273/73 D |
| 237,395 | 7/1925 | United Kingdom | 273/73 D |
| 3,127 of | 1885 | United Kingdom | 273/73 D |

*Primary Examiner*—Richard J. Apley
*Attorney, Agent, or Firm*—Kane, Dalsimer, Kane, Sullivan & Kurucz

[57] ABSTRACT

A method is disclosed for making a tennis, badminton or similar racket net. A board being provided with projecting nails, a thread or catgut is placed on the board along the sinuous contour of the cross-strings of a net and another thread or catgut is placed along the sinuous contour of the uprights of a net, using the nails as aids for defining said contours. Loops are formed at the connection between two successive cross-strings or uprights and the thus formed net is thereafter disengaged from the board.

10 Claims, 34 Drawing Figures

145
146
135
104
144
143
105
142
141
101

252
255
278
281
262
256
263
261
251

272
275
274
273
245₁
246₁

292
256
293

256
252
262
264
266
263
265
267
292
291
293

257
253
252
254
255
259
260
256

301
302
303
304
305
306
307
308
309
310
311
312
313
314
315
30
31

METHOD FOR MAKING A TENNIS, BADMINTON OR SIMILAR RACKET NET, NET OBTAINED BY THIS METHOD AND RACKET COMPRISING THIS NET

This invention relates to a method for making a tennis, badminton or similar racket net, a net obtained using this method and a racket provided with this net.

Making racket strings is a relatively long and delicate operation which requires a specialist and is costly. Failure to observe the specifications of the string network may result in deformation of the racket frame.

The invention relates to a stringing method free of these drawbacks.

Whereas up to now the stringing of a racket was carried out using several lengths of catgut or similar material from each one of which, through threading in holes present in the frame, one or more cross-strings and one or more uprights were provided and whereas precautions must be taken in order to maintain under stress that part of the string network effected and also in order to prevent the deformation of the frame, according to the invention, on the contrary, the net or string network is produced without the mediation of the racket frame, using a board or similar component on which are fastened nails or catches in positions such that by causing a length of catgut or thread to pass around said nails, said catgut or thread takes up a position along a sinuous path in conformity with that of the cross-strings of a string network and by causing another length of catgut or thread to pass around them, said catgut or thread takes up a position along the sinuous contour corresponding to the uprights of a string network.

The production of a net is therefore an operation which is distinct from the stringing of a racket. The latter is then carried out starting from a net prepared in advance and simply comprises the stressing of a net inside a frame.

Furthermore, loops are formed at the connections between two successive cross-strings and between two successive uprights and these loops, after having been threaded into crossing passages present in a racket frame, contribute to the stressing of the string network.

The loops crossing the frame are maintained by a thread or peripheral cable to the frame which is threaded into said loops and subsequently stressed, maintain occurring by means of a strap or staple receiving the loop and bearing against the thread or cable.

The invention provides for the application of said straps or staples into that part of the racket frame which is opposite the handle in order to protect said frame from wear due to friction on the ground.

In a modification, the extremities of the cross-strings or uprights are assembled to each other by threading a string extremity into the loop of an adjacent string and the strings closest to the handle are extended along tails inside the latter, pulling on said tails contributing to the stressing of the string network. Discs set into place before the assembly in that part of the frame opposite the handle provide then for protection from wear or deteriorations.

In one or the other of the embodiments, the periphery of the frame is ondulated, so that maintaining under stress of each string is elastic as a result of the fact that the part of the cable or thread is interposed between two successive ondulations like a bridge.

Uprights of the net extend along tails which are designed to penetrate inside a hollow racket handle and pulling on these tails contributes to the stressing of the string network.

The handle of the racket comprises, on the one hand, means adapted to cooperate with the tails in order to provide for the stressing of the corresponding uprights and, on the other hand, for the stressing of the peripheral cable of the frame or the string tails adjacent to the handle.

The following description given as an example, refers to the appended drawing in which:

FIG. 7 is a cross-sectional view along 7—7 of FIG. 5, to a larger scale;

FIG. 8 is a view of a string loop according to a particular embodiment;

FIG. 9 is a longitudinal sectional view along line 9—9 of FIG. 5 to a larger scale;

Figure 1:
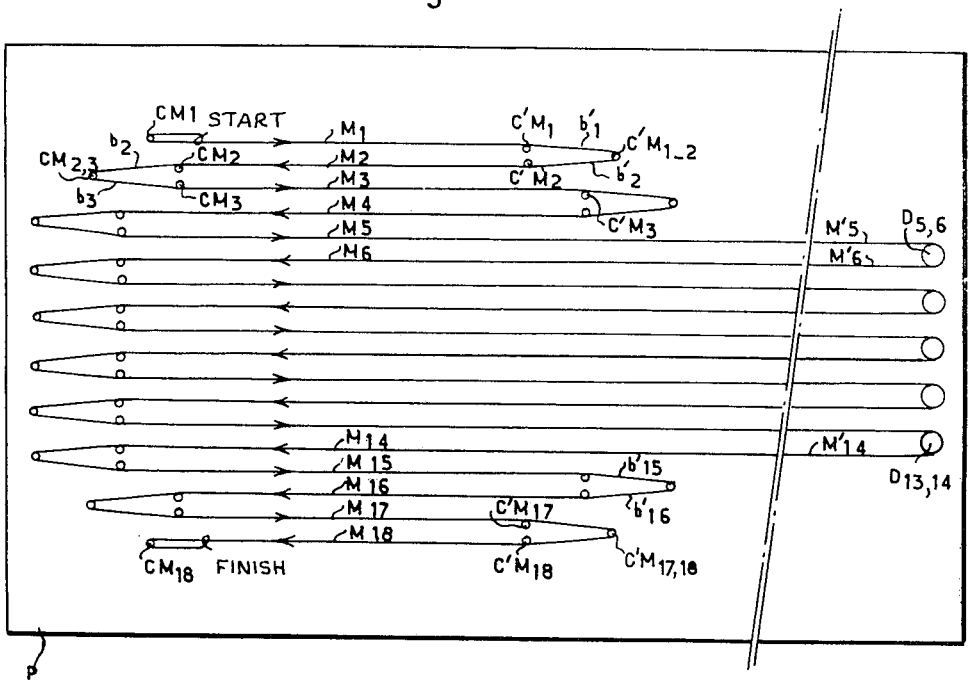
FIG. 1 is a plan view of a device for making a net during a production phase.

On a board P, for example, made of wood (FIG. 1), are arranged a certain number of nails in places which will appear clearly from the following: a first strand of catgut or synthetic thread, for example, made of nylon, is fastened onto a nail $CM_1$ and the thread or catgut is stressed along a first upright $M_1$ by causing it to pass around a nail $C'M_1$, and then a nail $C'M_{1,2}$ so as to form branches $b'_1$ and $b'_2$ on either side of nail $C'M_{1,2}$, and then a nail $C'M_2$ in order to form a second upright $M_2$ parallel to upright $M_1$ and distant from the latter by the usual distance between two neighbouring uprights of a net. The catgut or thread is then caused to pass around a nail $CM_2$ and then a nail $CM_{2,3}$ on either side of which it forms the branches of a V, respectively $b_2$ and $b_3$, and then a nail $CM_3$ in order to form an upright $M_3$, etc.. up to upright $M_5$.

Upright $M_5$ is extended along a strand $M'_5$ the length of which is somewhat less than that of a racket handle passing around a peg $D_{5,6}$ the diameter of which is equal to the space between two uprights, and strand $M'_6$ extends by upright $M_6$, etc..

From peg $D_{13,14}$ leaves strand $M'_{14}$ which extends by upright $M_{14}$. Upright $M_{15}$ is not extended by a strand so that it connects with upright $M_{16}$ through two V-shaped branches $b'_{15}$ and $b'_{16}$. Upright $M_{17}$ passes around nail $C'M_{17}$ and then nail $C'M_{17,18}$ and beyond nail $C'M_{18}$ the thread extends by upright $M_{18}$ which passes around nail $CM_{18}$ where it is fastened.

Figure 2:
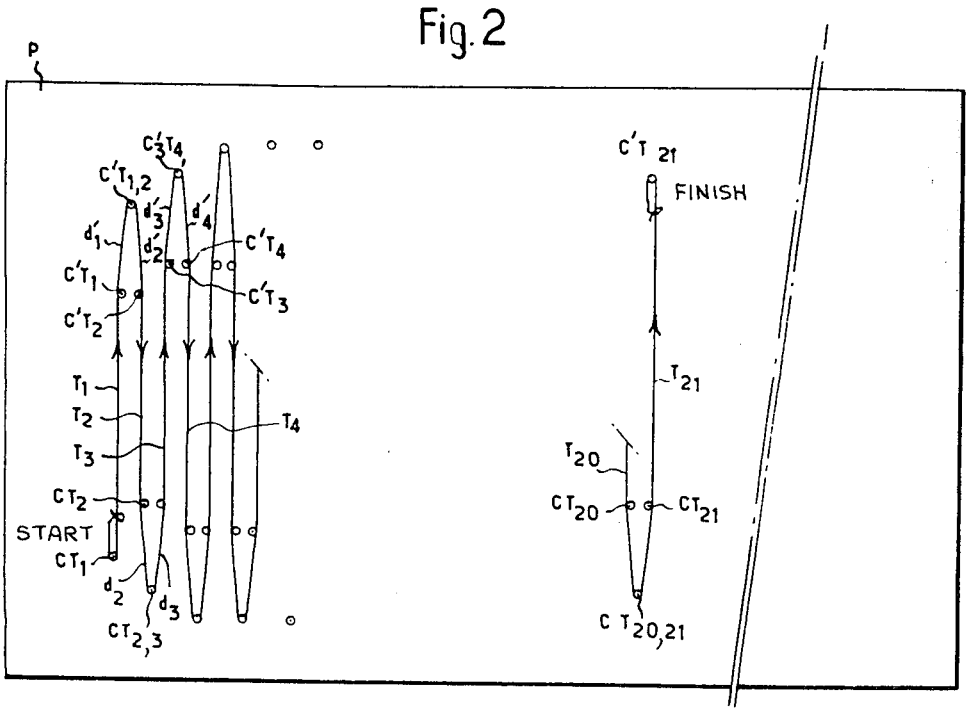
FIG. 2 is a view similar to that of FIG. 1 but for another phase.

The cross-strings are similarly formed on the same board P: from a nail $CT_1$ (FIG. 2) close to which is fastened the extremity of a thread or catgut comprising the cross-strings, the thread or catgut passes successively on nails $C'T_1$, $C'T_{1,2}$, $C'T_2$ and continues through cross-string $T_2$, the branches $d'_1$ and $d'_2$ on either side of nail $C'T_{1,2}$ being shaped as a V. At each encounter of the thread or catgut of the cross-strings with the thread or catgut of the uprights, an overlapping occurs, so that, for example, cross-string $T_1$ passes above the first upright which it encounters, which is upright $M_{15}$ and then below the following upright which is upright $M_{14}$, etc.. as is usual in a string network. The connection between cross-string $T_3$ and cross-string $T_4$ is effected by passing around nails $C'T_3$, $C'T_{3,4}$, $C'T_4$ with formation of branches $d'_3$ and $d'_4$ and so on.

Cross-string $T_{20}$ connects with cross-string $T_{21}$ by passing around nails $CT_{20}$, $CT_{20,21}$, $CT_{21}$. The extremity of the thread or catgut is fastened close to nail $C'T_{21}$.

Figure 3:
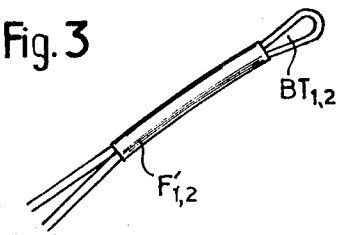
FIG. 3 is a view of a loop.

The branches of the V's on either side of a same nail, for example, $b'_1$, $b'_2$; $b_2$, $b_3$; etc., $d'_1$, $d'_2$; $d_2$, $d_3$; $d'_3$, $d'_4$, etc. are enclosed in a casing, for example, $F'_{1,2}$ for the branches $d'_1$, $d'_2$, which thus ensure the formation of a small loop $BT_{1,2}$ (FIG. 3). A casing or sleeve, F or F', is made of a retractable material; after the formation of a loop and threading, an increase in temperature provides for contraction and thus for the integralization with the thread or catgut which it surrounds.

Figure 4:
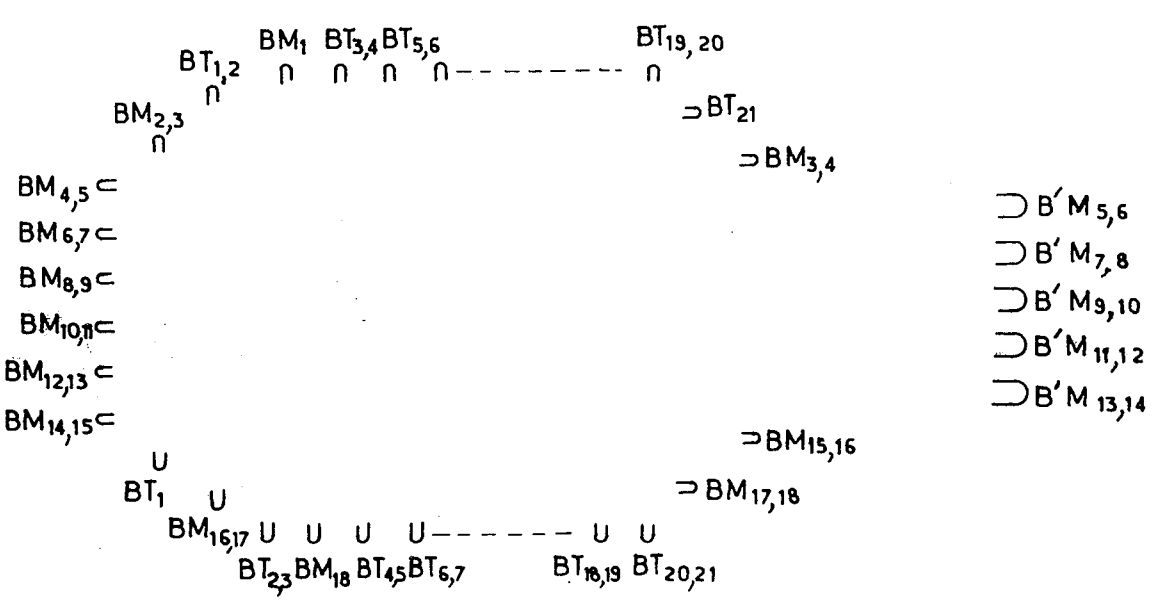
FIG. 4 is a schematic view of the arrangement of the loops of a net.

The various loops of the string network are arranged as shown in the diagram of FIG. 4: from left to right and above, loop $BT_{1,2}$ is followed by loop $BM_1$, the notation meaning that it forms the end of upright $M_1$; loop $BM_1$ is followed by loop $BT_{3,4}$ which means that the loop belongs to the cross-strings $T_3$ and $T_4$ and then by loop $BT_{5,6}$, etc.. After loop $BT_{19,20}$, is found loop $BT_{21}$ and then loop $BM_{3,4}$.

The following loops have been designated B' in order to indicate that they are at the end of strands designed to extend on the inside of the handle. Thus, in succession, are found loop $B'M_{5,6}$, loop $B'M_{7,8}$, loop $B'M_{9,10}$, loop $B'M_{11,12}$, loop $B'M_{13,14}$.

The following loop is a loop which connects directly to two uprights: it is loop $BM_{15,16}$ which can be seen in the lower part. Then, from right to left, in succession, are found loops $BM_{17,18}$, loops $BT_{20,21}$, loops $BT_{18,19}$, etc., $BT_{6,7}$, $BT_{4,5}$, $BM_{18}$, $BT_{2,3}$, $BM_{16,17}$ up to loop $BT_1$. Then are found loops for the uprights, from bottom to top, in succession $BM_{14,15}$, $BM_{12,13}$, $BM_{10,11}$, $BM_{8,9}$, $BM_{6,7}$, $BM_{4,5}$, $BM_{2,3}$.

Figure 5:
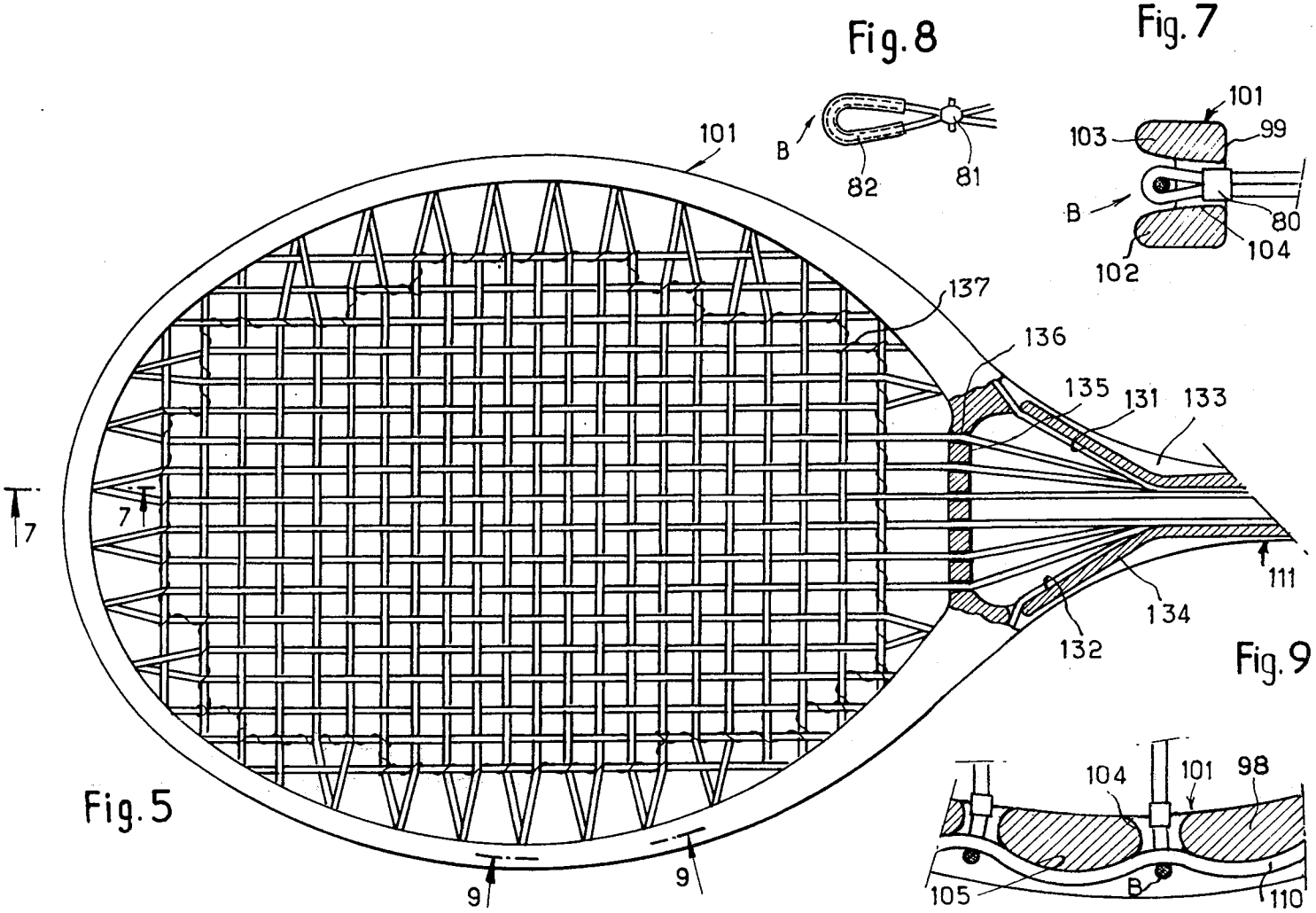
FIG. 5 is a view of part of a racket according to the invention partially broken away.

A cord 137 is then rolled around the string parts which would acquire obliqueness when put under stress as explained hereinafter, as a result of the connection between the adjacent cross-strings and adjacent uprights along converging parts. The sides of the squares surrounded by such a cord have been marked off on the drawing (FIG. 5).

The cord 137 is impregnated with a thermosetting resin, for example, an epoxy resin so that after curing, the non-deformability of the rectangle, one side of which is surrounded by the cord, is thus ensured.

The net which has tails consisting of strands M' can be given separately to the racket manufacturer or repairman. It is ready to be assembled to a racket frame.

Figure 6:
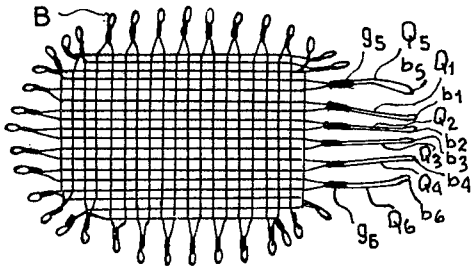
FIG. 6 is a view to a similar scale of a net.

Shown in FIG. 6 to a smaller scale, is a net which is distinct from that described above only by the fact that it comprises four central tails, $Q_1$, $Q_2$, $Q_3$, $Q_4$ each extending two uprights and ending with small loops $b_1$, $b_2$, $b_3$, $b_4$, as well as two lateral tails $Q_5$, $Q_6$, each also extending two uprights and ending with loops $b_5$ and $b_6$, which are longer than loops $b_1$ to $b_4$. The length of loops $b$ is determined by the length of the respective sleeves $g$ which is greater for sleeves $g_1$ to $g_4$ than for sleeves $g_5$ to $g_6$.

A net with peripheral loops B and with tails ending with loops $b$ can also be obtained by molding of a fiber loaded resin.

A peripheral loop B is defined by a ring or disc 80 enclosing the two strands from which the loop originates (FIG. 7).

In the modification shown in FIG. 8, loop B is defined by a ligature 81 and is wrapped in a sleeve 82.

A net as shown in FIG. 4 or FIG. 6 may be assembled with a racket frame made of wood, metal or reinforced plastic material. Frame 101 (FIGS. 5,7, or 9) has a U-shaped cross-section with two branches 102 and 103 the base of which 98 provides crossings 104 between the internal face 99 of the base and the external face 105. The latter has undulations so that on either side of a hole in a crossing 104, the distance of the external face 105 to the internal face 99 first increases and then decreases until the next hole (FIG. 9).

Figure 11:
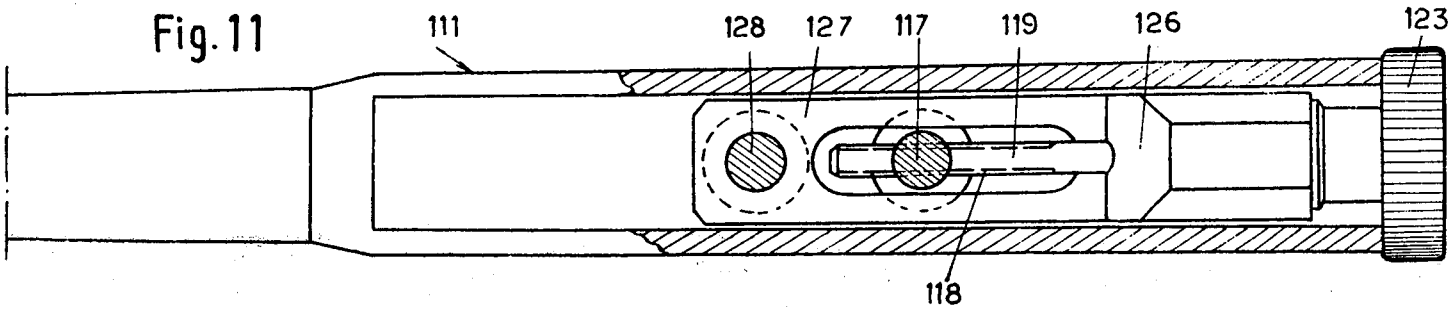
FIG. 11 is a view similar to that of FIG. 10 but along a perpendicular section.
Figure 10:
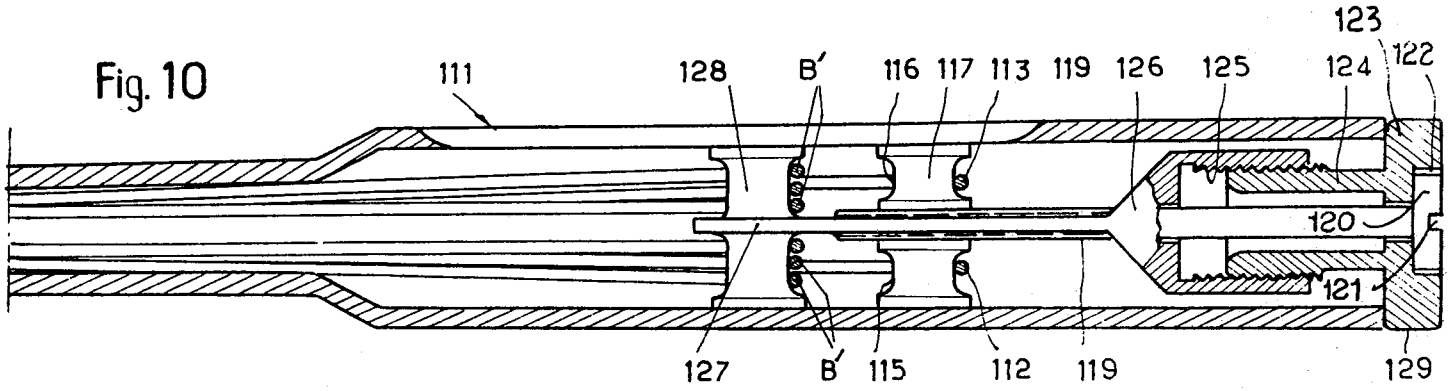
FIG. 10 is a longitudinal sectional view of a racket handle.
Figure 12:
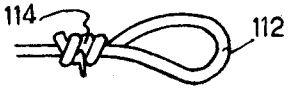
FIG. 12 is a view of a loop.

As far as stringing of the frame is concerned, loops B are simply threaded into holes 104 at corresponding positions of the frame 101. Loops B project with respect to the external surface 105 and in the loops is threaded a thread or cable 110. Said cable has its ends housed in a tubular handle 111 of the racket (FIGS. 10 and 11) and each one of them is formed by a loop, respectively 112 and 113, ligatured as shown in 114 (FIG. 12). Loops 112 and 113 are arranged around grooves 115 and 116 of a first spool 117 housed inside handle 111. Spool 117 has a threading crossing 118 and the latter co-operates with a thread in a rod 119 which is coaxial with the handle and which ends with a head 120 comprising slit 121 providing for rotation with a screw-driver. Head 120 is housed in a cavity 122 located on a stopper 123 shaped as a disc which seals the end of the handle. Said stopper extends through a tube 124 threaded on the outside and with which co-operates a threading 125 of a tubular nut 126 which extends through a tail 127. A second spool 128 which is threaded into loops B' is integral with tail 127.

Slab 129 of stopper 123 is knurled and, through rotation of said stopper, it is possible to increase or decrease the stress of strands M' extending the uprights. Through rotation of head 120 using a coin, the stress on cable 110 is increased or decreased. When the stress of said cable increases, loops B are pulled towards the outside and this occurs as a result of the convexities formed by the undulations of the external surface 105 of a base 98 and on which bears cable 110 on either surface 105 of a base 98 and on which bears cable 110 on either side of the loop. Each cord is thus fastened to its ends on elastic bridges formed by the cable portions between two successive convexities. The stress of the string network can thus be set at will.

Cable 110 bears against the internal faces 131 and 132 of legs 133 and 134 for the connection of handle 111 to frame 101.

Strands M' cross the cross-piece 135 through holes 136 present in the latter.

Figures 13, 22, 23, 24, 25, 26:
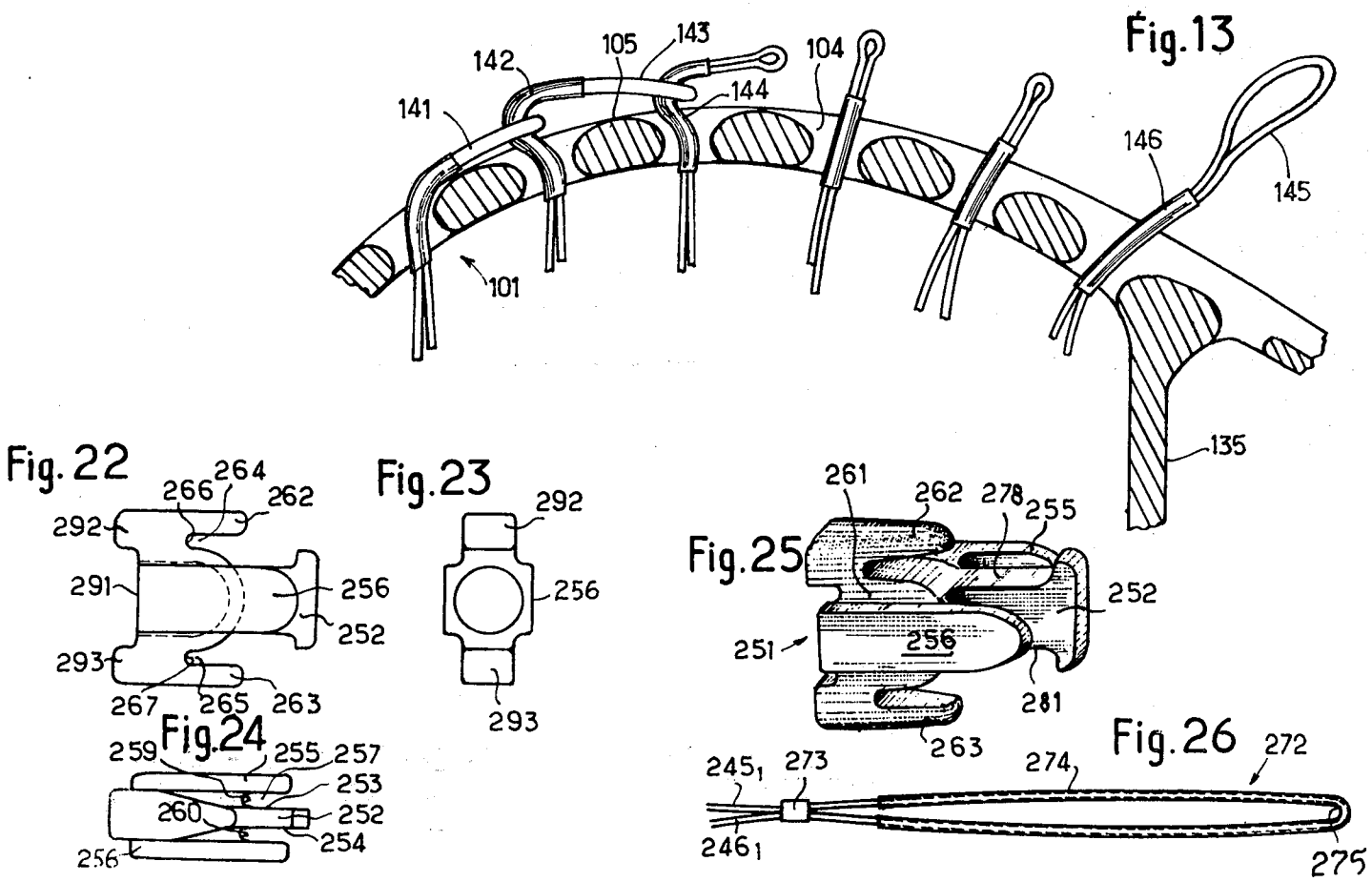
FIG. 13 is a sectional view of part of a racket for a modification.
FIG. 22 is a view of a tightener.
FIG. 23 is an end view of said tightener.
FIG. 24 is a view similar to that of FIG. 22, but at 90° to the latter.
FIG. 25 is a perspective view of the tightener.
FIG. 26 is a view of a loop of central uprights.

In the modification shown in FIG. 13, a loop 141 projects sufficiently with respect to the external surface 105 of the base 99 of frame 101 in order for sleeve 142 to be engaged therein. Loop 143 projecting with respect to sleeve 142 is useful in turn for the engagement of an adjacent sleeve 144, etc..

Loop 145 of sleeve 146 which is the closest to cross-piece 135 is useful for stressing the cords as a whole.

Stressing of the strands inside the handle can also occur through twisting.

The strands inside the handle are made to follow a sinuous path so as to increase their length and thus their twisting possibilities.

Figure 14:
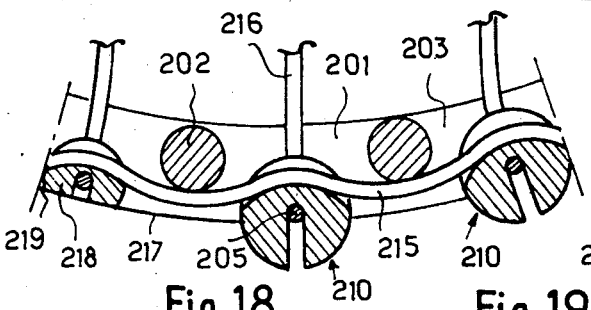
FIG. 14 is a sectional view of part of a racket through the mean plane of the frame.
Figure 15:
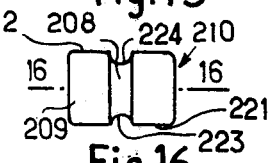
FIG. 15 is a view of a strap.
Figure 17:
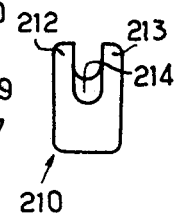
FIG. 17 is a view of a strap, but perpendicularly to the view shown in FIG. 15.
Figure 16:
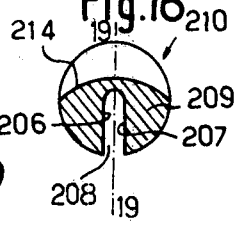
FIG. 16 is a sectional view along line 16—16 of FIG. 15.
Figure 18:
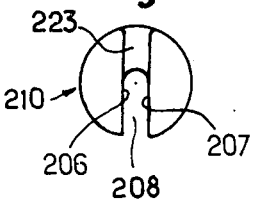
FIG. 18 is another view of a strap.

In the embodiment shown in FIG. 14, the crossings 201 are provided by cross-pieces 202 interposed between two parallel flanges 203 which are part of the frame basket. A loop 205 is engaged between faces 206 and 207 which are provided by a slit 208 cut into the body 209 of a strap or staple 210 (FIGS. 15 to 19) shaped as a pellet. Said strap has a milling 211 limiting branches 212 and 213 and having a convex bottom 214, the median milling plane 211 being perpendicular to the median plane of slit 208. The stressing of a peripheral thread or cable 215 housed in the milling 211 applies said cable against the periphery of the cross-pieces 202 and furthermore ensures the stressing of cords 216 which form loops 205. Cable 215 which bears on rounded parts of cross-pieces 202 thus ensures an elastic hooking of cords 216 favoring the performance of the racket during the game.

Figure 19:
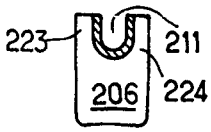
FIG. 19 is a view similar to that of FIG. 17, but for a modification.

A coating can be provided on the surface of the staple defining the milling 211 as shown in FIG. 19.

In the embodiment shown in FIGS. 15 to 19, the strap projects with respect to slab 217 of the frame and thus prevents the latter's contact with the ground when the racket is used to pick up a ball. Wear of the frame is thus avoided.

In the embodiment shown in 218 in FIG. 14, the strap is truncated on its body 209 so that face 219 resulting from the truncated character is recessed with respect to slab 217. Such a strap is used in those parts of the racket which are not opposite the handle and thus do not risk being worn out through contact with the ground.

Figure 20:
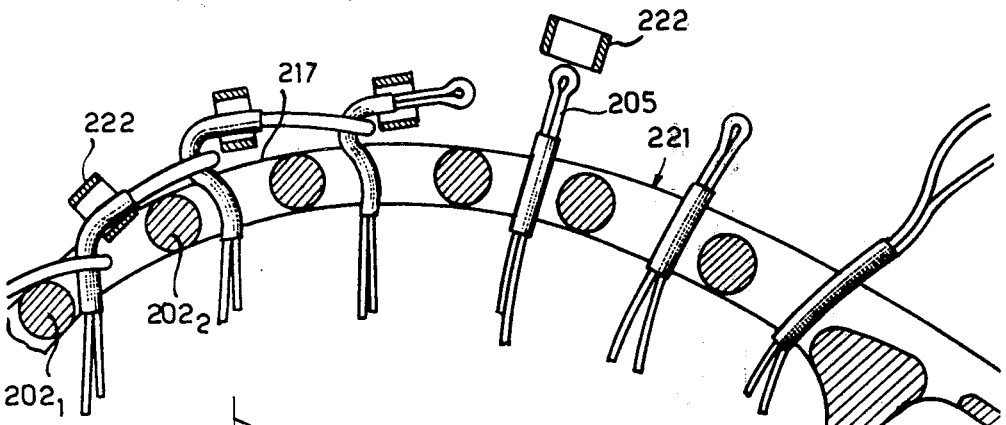
FIG. 20 is a view similar to that of FIG. 13 but for another embodiment.

In the embodiment shown in FIG. 20, protection of the racket frame is obtained by threading a disc 222 towards the end of loop 205, the disc being, when the net is under stress, as shown on the left part of FIGS. 13, between two cross-pieces $202_1$ and $202_2$ of the frame, projecting with respect to slab 217 of the latter and thus ensuring its protective role from wear.

The disc is also shown in its position before stressing of the various tails, also in its position before threading of the adjacent loop into the loop surrounded by the disc, finally in its position before its engagement at the end of the loop.

Figures 21, 27, 28:
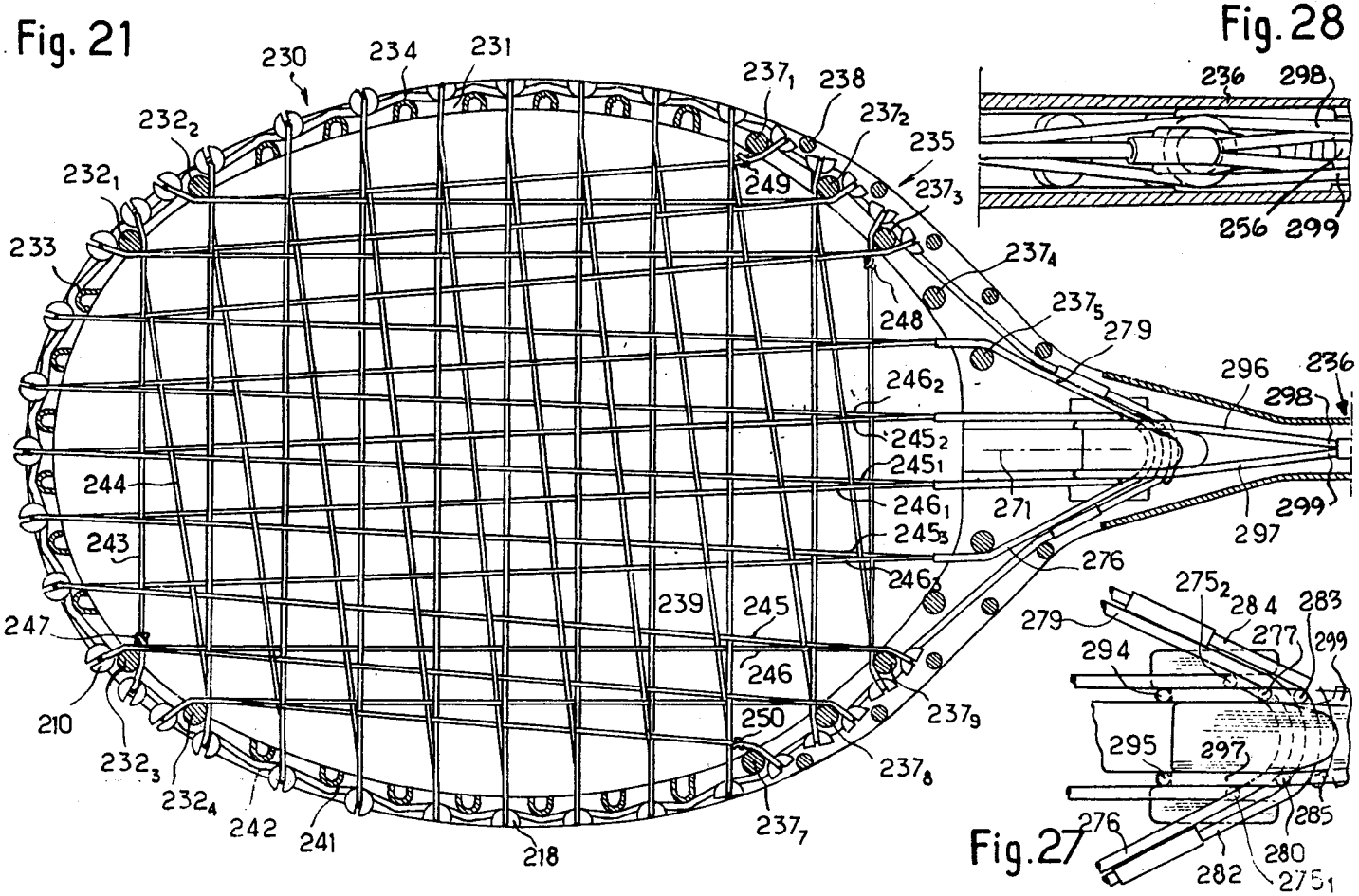
FIG. 21 is a sectional view of part of a racket according to another embodiment, along the mean plane of the frame.
FIG. 27 is a view to a larger scale of a part of FIG. 21 showing the hooking of the loops onto the tightener.
FIG. 28 is a sectional view along a plane perpendicular to the mean plane of the frame at the latter's connection with the handle.

In the embodiment shown in FIG. 21, frame 230 of the racket comprises two flanges 231 made integral with each other through cross-pieces. Cross-pieces $232_1$, $232_2$ and $232_3$, $232_4$, in the lateral parts of the frame opposite the handle, are solid and comprise a circular section. Cross-pieces 233 in the central part of the frame opposite the handle have a U-shaped section.

They also have a U-shaped section on the median lateral parts of the frame as shown in 234. On the opening parts of the frame 235, connecting with the handle, solid cross-pieces are found having a circular section 237 along an internal row and solid cross-pieces 238 along an external row which also have a circular section but smaller than that of cross-pieces 237.

In this embodiment, also, net 239 is autonomous, prepared in advance and provided with its straps which are also of two types, i.e., straps 210 designed to stress the net, when mounting it onto the frame through the action of a banding thread or cable 241 and which, in addition, protect the frame by avoiding the contact of slab 242 of the latter with the ground, and straps 218 which play the same roles except that which has just been mentioned.

Net 239, in this embodiment, consists of horizontal cross-strings (in the case in which the handle of the racket is placed vertically) 243, of oblique cross-strings 244 and of oblique uprights 245 and 246. The configuration of the cross-strings is thus of the zigzag type and the same is true of the configuration of the uprights.

The extremities of the cord or similar component comprising the cross-strings are shown in 247 and 248 and the extremities of the cord comprising the uprights are shown in 249 and 250.

The stressing of the net occurs through a tightener 251 (FIGS. 22 to 25) which is advantageously made of a light alloy comprising, on either side of a central core 252 limited by two parallel faces 253 and 254, small tongues 255 and 256, defining with said core, housings 257 and 258 ending in convex bottoms 259 and 260.

On either side of body 261 are two ears 262 and 263 the mean parallel planes of which are perpendicular to the mean planes of the small tongues 255 and 256. The ears 262 and 263 provide with body 261 housings 264 and 265 the bottoms of which are shown in 266 and 267.

The uprights $245_1$ and $246_1$ which are closest to axis 271 of the racket and one side of the latter are connected along a loop 272 (FIG. 26) limited by a tightening ring 273. Loop 272 is protected by a sleeve 274. Loop 272 is engaged in the housing 265 and its apex 275 (FIG. 27) comes into contact with bottom 267. Similarly, the loop which ends the symmetrical uprights with respect to axis 271, i.e., uprights $245_2$ and $246_2$, is engaged in the housing 264 and its apex is in contact with bottom 266.

The uprights which follow uprights $245_1$ and $246_1$, i.e., $245_3$ and $246_3$, form a loop $276_3$. The latter is threaded around a core 252 and its apex 277 comes into contact with slab 278 of said core. The symmetrical loop 279 is also engaged around said core and its apex 280 comes into contact with the opposite slab 281 of core 252.

The thread or cable 241 ends with a loop 282, which is engaged around core 252, beyond the first two loops and its apex 283 is in contact with slab 278. The other end of the thread or cable 241 forms a loop 284 the apex of which 285 is in contact with slab 281 of core 252.

The body 261 of tightener 251 has, opposite core 252, a platform 291 bordered by rims 292 and 293. It is with this platform that apices 294 and 295 of loops 296 and 297 are in contact forming the extremity of slings 298 and 299 (FIG. 28) housed inside the handle 236.

The other extremities of the slings also form loops 301 and 302 and said loops are engaged in grooves 303 and 304 (FIG. 29) having a semi-circular configuration, present in a head 305 (FIGS. 30 to 32) having a generally rectangular shape and housed in the compartment 306 inside the handle with a corresponding cross-section.

Figures 29, 30, 31, 32, 33:
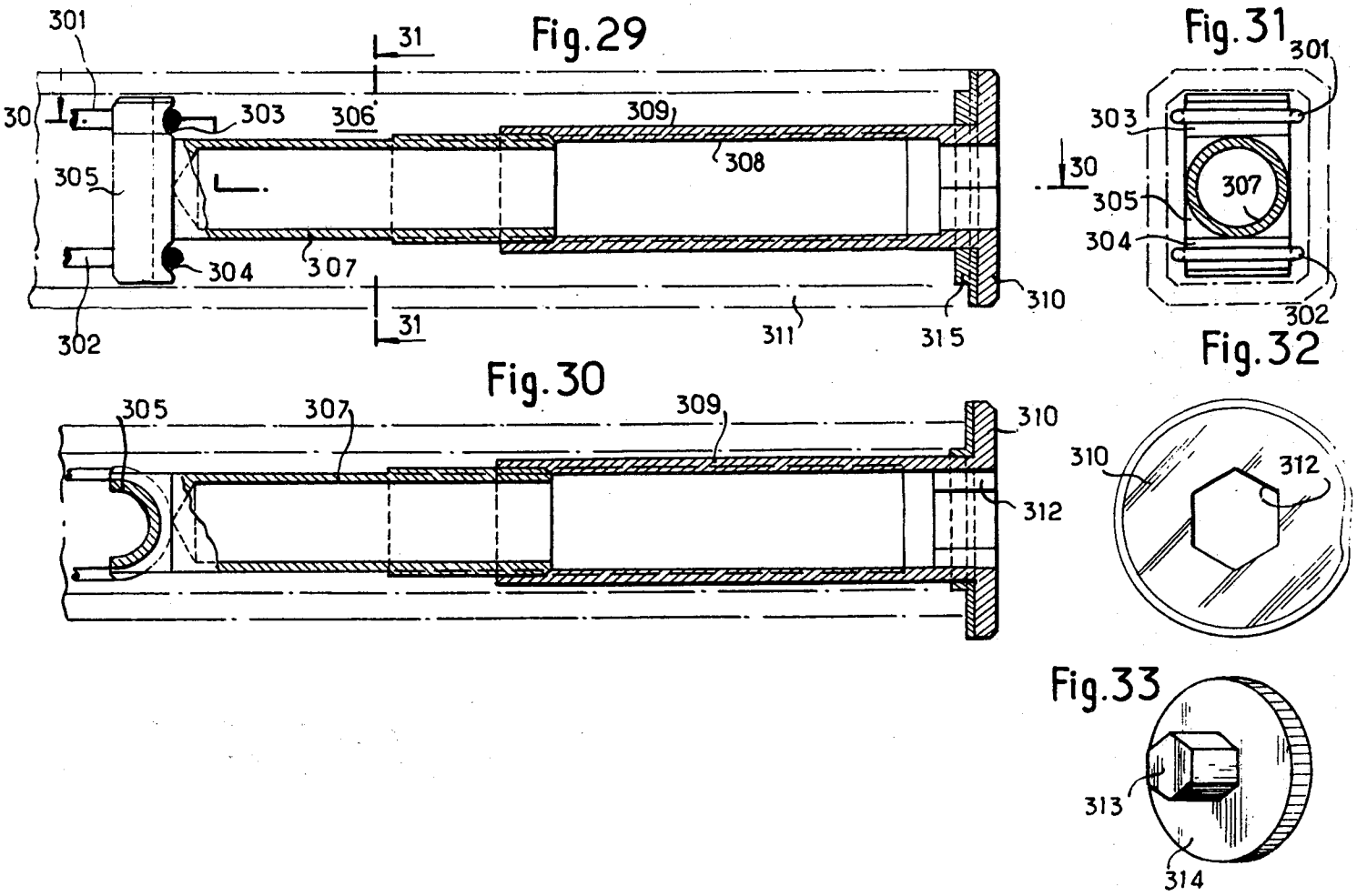
FIG. 29 is a sectional view of a handle.
FIG. 30 is a sectional view along line 30–30 of FIG. 29.
FIG. 31 is a sectional view along 31—31 of FIG. 29.
FIG. 32 is an end view of the handle through its back end.
FIG. 33 is a perspective view of a stressing tool.

Head 305 is integral with an externally threaded tube 307 which co-operates with the internal threading 308 of a tube 309 which ends at its opposite extremity with a base 310 sealing body 311 of the racket handle. Base 310 comprises a hexagon or similar shape 312 for its putting into rotation, for example, through the projecting part 313, having a conjugated shape, of an actuating circular tool 314 (FIG. 33). A disc 315 is interposed between the base 310 and the body 311 of the racket handle.

When base 310 is turned in a suitable direction, the tube 307 is pulled towards said base, head 305 opposing the rotation of said tube. The slings 298 and 299 exert their action on the tightener 251 and simultaneously, the peripheral cable 241 and the central uprights 245, 246 of the racket net are placed under stress. At the moment the stress is exerted, small tongues 255 and 256 of the tightener oppose the disengagement of the loops in which core 252 is engaged.

As cable 241, which bears against the frame cross-pieces, is placed under stress, the bridges formed by said cables between the two adjacent cross-pieces are stretched, which results in the stressing of the cords overlapping the strap on which the action of said bridge is exerted. As a result, there occurs, in conjugation with the action exerted directly onto the central uprights, a uniform stressing of all component cords of the net and at a value which is suitable for the ball game.

Figure 34:
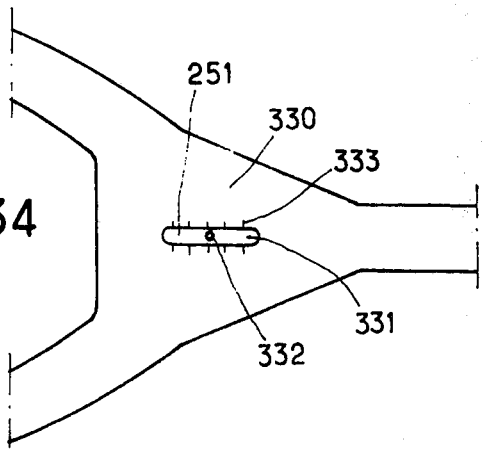
FIG. 34 is a view of part of a frame according to a particular embodiment.

In the embodiment shown in FIG. 34, frame 330 has a window 331 through which a reference mark 332 is visible carried by tightener 251. At the moment of stressing, said reference mark moves in front of the graduations of a scale 333. It is thus possible to be informed at any moment as to the degree of stress of the string network and to make adjustments in accordance with the wishes of the player.

I claim:

1. A tennis, badminton, or similar racket net, capable of being mounted to a frame, which comprises:

a. cross-strings formed by the sinuous threading of a thread-like material;

b. upright strings formed by the sinuous threading of a thread-like material, and interwoven with the cross-strings;

c. tie means connecting each successive pair of uprights and cross-strings, respectively, thereby defining independently of the frame of the racket closed loops along the periphery of the net which may be used for applying tension to the net once it has been mounted on the frame, and d. at least one cord interwoven with the uprights and cross-strings near the closed loops in order to maintain a parallel relationship between each pair of successive uprights and each pair of cross-strings, respectively.

2. The net according to claim 1 in which the tie means is a sleeve.

3. The net according to claim 1 in which the tie means is a ligature.

4. The net according to claim 1 in which at least one of the closed loops defined by the uprights and the associated tie means is larger than the closed loops defined by the cross-strings and their associated tie means.

5. A tennis, badminton, or similar racket comprising:

a. a handle;

b. a frame containing a plurality of holes, and having a convex shape in the areas between said holes;

c. a net containing peripheral closed loops which extend through the holes in the frame;

d. a cable located along the periphery of the frame, and in a threaded relation with said closed loops; and e. a means for applying tension to said cable so that the closed loops are pulled out as the portions of the cable overlying the holes approaches the level defined by the apices of adjacent convex areas of the frame.

6. The racket according to claim 5 in which a groove is provided around the periphery of the frame for receiving the cable.

7. The racket according to claim 5 in which the means for applying tension in the handle is located at the end of the handle opposite the frame.

8. The racket according to claim 5 in which the frame is constituted by two symmetrical flanges, an where cross-pieces between said flanges define the convex shapes in the areas between the holes in the frame.

9. The racket according to claim 5 in which a means for applying tension directly to at least some of the closed loops is provided.

10. The racket according to claim 5 in which the net comprises:

a. cross-strings formed by the sinuous threading of a thread-like material;

b. upright strings formed by the sinuous threading of a thread-like material, and interwoven with the cross-strings;

c. tie means connecting each successive pair of uprights and cross-strings, respectively, thereby defining closed loops along the periphery of the net, and d. at least one cord interwoven with the uprights and cross-strings near the closed loops in order to maintain a parallel relationship between each pair of successive uprights and each pair of cross-strings, respectively.

* * * * *

UNITED STATES PATENT AND TRADEMARK OFFICE

CERTIFICATE OF CORRECTION

PATENT NO. : 4,118,029

DATED : October 3, 1978

INVENTOR(S) : Jacqueline Septier

It is certified that error appears in the above-identified patent and that said Letters Patent are hereby corrected as shown below:

At Column 5, line 15, - after 110 delete "on either surface 105 of a base"

At Column 5, line 16, - delete "98 and on which bears cable 110"

At Column 8, Claim 8, line 44 "an" should read -- and --.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*